US006240268B1

(12) United States Patent
Nishiuwatoko

(10) Patent No.: US 6,240,268 B1
(45) Date of Patent: May 29, 2001

(54) GAP RETAINING MEMBER AND DEVELOPING DEVICE EMPLOYING THE SAME

(75) Inventor: Tsutomu Nishiuwatoko, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/473,958

(22) Filed: Dec. 29, 1999

(30) Foreign Application Priority Data

Jan. 14, 1999 (JP) ..... 11-007915

(51) Int. Cl.[7] ..... G03G 15/00; G03G 15/08
(52) U.S. Cl. ..... 399/119; 399/222; 399/265
(58) Field of Search ..... 399/119, 222, 399/252, 265

(56) References Cited

FOREIGN PATENT DOCUMENTS 59-140253 * 8/1984 (JP) .
4-63866 * 2/1992 (JP) .
5-257372 * 10/1993 (JP) .

* cited by examiner

*Primary Examiner*—Joan Pendegrass
(74) *Attorney, Agent, or Firm*—Fitzpatrick, Cella, Harper & Scinto

(57) ABSTRACT

A gap retaining member featuring high durability and high resistance to frictional charging is provided as a means for retaining a gap between an image bearing member and a developer bearing member in an image forming apparatus. The gap retaining member for maintaining a gap between the image bearing member and a cylindrical portion of the developer bearing member in the image forming apparatus, which has at least the image bearing member and the cylindrical developer bearing member that is rotatably held, is formed of a material that is composed of at least a polybutylene terephthalate resin and a reinforcing material.

15 Claims, 4 Drawing Sheets

GAP RETAINING MEMBER AND DEVELOPING DEVICE EMPLOYING THE SAME

BACKGROUND OF THE INVENTION

1. Field of the Invention

The present invention relates to an image forming apparatus, such as a laser printer, a copying machine, or a facsimile, that employs electrophotographic technology. More particularly, the present invention relates to a member for retaining a gap between an image bearing member and a developer bearing member.

2. Description of the Related Art

Referring to FIGS. 2 and 3, an image forming apparatus 1 that employs electrophotographic technology selectively exposes a photosensitive drum 20, which is an image bearing member and has been uniformly charged by a charging device 30, by an exposure device 3 to thereby form a latent image on the photosensitive drum 20. The latent image is developed using a developer or toner T, and the developed image is transferred to a recording medium P, such as paper or OHT. Then, the transferred image on the recording medium P is pressed and thermally fixed using a fixing device 9 so as to record the image. Upon completion of transferring the image toner, the toner remaining on the photosensitive drum 20 is removed by a cleaning device 50 before another cycle of the image forming process beginning with electrical charging is started.

As the photosensitive drum 20 used with such an image forming apparatus, a photosensitive drum has been known, in which a conductive base material, such as aluminum, is employed as a base member 21, and a photoconductive material providing a photosensitive layer 22 is coated on the base member 21 as shown in FIG. 5. Conventionally used photoconductive materials include inorganic photoconductive materials, such as selenium, cadmium sulfide, and zinc oxide, and organic photoconductive materials, such as polyvinyl carbazole, oxadiazole, and phthalocyanine. When using an organic photoconductive material, in particular, it has been known to use, for the purpose of sensitization, the photosensitive layer 22 formed of a laminate of an electric charge generating layer 22*a* and an electric charge transporting layer 22*b* to separately provide different functions. The electric charge transporting 22*b* serving as a surface layer that uses polycarbonate as a binder has been put in practical use.

A developing device 40 that has been put in practical use is constituted by a toner chamber 45 holding a toner T, a developer supply chamber 44, a developer bearing member or a developing roller 41, and a developer restricting member or a developing blade 42 as shown in FIG. 3.

The developing roller 41 is formed of a conductive material, such as aluminum, and rotatably retained with a predetermined gap, preferably 0.2 mm to 0.5 mm, from the photosensitive drum 20. The developing roller 41 incorporates therein a magnet roller 43 having a plurality of magnetic poles. The magnet roller 43 is retained by a developing device frame 46 so that it does not rotate as shown in FIG. 5.

The developing blade 42 is secured to the developing device frame 46 such that one end thereof is pressed against an outer peripheral surface of the developing roller 41.

As shown in FIG. 3, the toner T of the toner chamber 45 is carried from the toner chamber 45 to the developer supply chamber 44 by its own weight or a carrying means (not shown), and drawn to the vicinity of the developing roller 41 by a magnetic force of the magnet roller 43. The toner T carried to the vicinity of the developing roller 41 is carried toward the developing blade 42 by the rotation of the developing roller 41, restricted in its layer thickness by the developing blade 42, then carried toward the photosensitive drum 20. At this point, a predetermined level of electric charge is imparted to the toner T having its layer thickness restricted when passing through a nipped portion between the developing blade 42 and the developing roller 41.

In the aforesaid developing device 40, means for stably holding the developing roller 41 and the photosensitive drum 20 with a predetermined gap therebetween is formed of polyacetal, and has substantially cylindrical gap retaining members or spacer rollers 60 having a wall thickness of, for example, 0.2 mm to 0.5 mm. The spacer rollers 60 are rotatably fitted at both ends of the developing roller 41, and the developing roller 41 is pressed toward the photosensitive drum 20 by a compression spring 54 functioning as an urging means, as shown in FIGS. 1 and 4. Two typical examples are shown in FIG. 1.

Extended use of the image forming apparatus 1 requires supply of the toner T and adjustment, cleaning, or replacement of the photosensitive drum 20 and other means for implementing diverse processes. Such maintenance and service have been difficult in practice for people other than servicemen with expertise.

To overcome the difficulty mentioned above, a process cartridge 2 shown in FIG. 2, for example, has been devised and put in practical use. The process cartridge 2 combines processing means, such as the toner T, the photosensitive drum 20, the developing device 40, the charging device 30, and the cleaning device 50, into one unit. The process cartridge 2 is detachably installed on the image forming apparatus 1, thus improving maintainability.

With recent dissemination of the image forming apparatus 1, there have been demands for a reduced size, a reduced noise, and lower cost of the image forming apparatus (apparatus main body) 1. The reduction of noise and cost has been studied and achieved by obviating the need for an exhaust fan. As other measures for achieving the lower cost, the material used for a main body frame 1*a* has been changed from a sheet metal to a resin to permit one-piece molding. However, an attempt to achieve the reduced size, the controlled noise, and the lower cost of the apparatus main body 1 employing the conventional spacer rollers 60 has been facing difficulties set forth below.

The apparatus main body 1 includes various heat generating sources, including the fixing device 9. Making the apparatus main body 1 smaller would cause the temperature in the apparatus main body 1 to rise more easily. Especially in the case of the apparatus main body 1 not equipped with an exhaust fan, the temperature in the apparatus main body 1 would rise more easily.

The spacer rollers 60 are repeatedly subjected to compressive stress. Hence, if the apparatus main body 1 is made smaller or not provided with an exhaust fan, then the spacer rollers 60 will be repeatedly subjected to compressive stress at a high temperature. In the case of an apparatus that employs the spacer rollers 60 that can be fitted at the ends of the developing roller 41 as shown in FIG. 1, there has been a danger in that the spacer rollers 60 incur rolling deformation. As a result, prolonged use of the apparatus may cause the spacer rollers 60 to fail to maintain a proper gap.

In addition, the outer peripheries of the spacer rollers 60 are usually pressed against the photosensitive layer 22 of the photosensitive drum 20. The spacer rollers 60 are repeatedly brought into contact with and moved away from the photosensitive layer 22, and the friction from sliding against each other causes the outer peripheral surface of the spacer rollers 60 to be easily charged.

The photosensitive layer 22 of the photosensitive drum 20 is preferably short from the viewpoint of manufacturing process and cost. For this reason, it is desirable to expose the base member 21 of the photosensitive drum 20 at both end areas not involved in formation of images as shown in FIG. 5 rather than providing those end areas also with the photosensitive layer 22.

Because of the exposed areas, there have been cases where the surfaces of the spacer rollers 60 are charged, and the electric charges are discharged to exposed portions 21*a* of the base member of the photosensitive drum 20, radiating a field emission voltage. There has been a danger in that the field emission voltage passes through a resinous frame and radiates out of an apparatus main body in some cases. Therefore, depending on a combination of the spacer rollers 60 and the photosensitive layer 22, it has been required to provide the apparatus main body 1 with an electrical shielding by, for example, providing a sheet metal component for shielding in order to prevent field emission voltages from being radiated out of the apparatus main body 1. This has been interfering with achieving a reduced cost of the apparatus main body 1.

SUMMARY OF THE INVENTION

Accordingly, an object of the present invention is to provide a gap retaining member that incurs minimized rolling deformation when subjected to repetitive compressive stress.

Another object of the present invention is to provide a gap retaining member that minimizes discharge between a contact portion of the gap retaining member and an exposed portion of a base member of a photosensitive drum.

Still another object of the present invention is to provide a developing device and a process cartridge that employ such a gap retaining member.

The inventors have diligently studied in view of the situations set forth above, and achieved a spacer roller that is highly resistant to rolling deformation, wear, and frictional charging at high temperature, by employing an annular gap retaining member, namely, a spacer roller, having a base member thereof formed of polybutylene terephthalate (PBT) as a means for maintaining a constant gap between a developing roller and a photosensitive drum in an image forming apparatus wherein the developing roller and the photosensitive drum are held with a predetermined gap provided therebetween. The inventors have attained the present invention by adopting the spacer rollers that are able to realize an apparatus main body that is smaller, quieter, and less expensive.

According to one aspect of the present invention, there is provided a gap retaining member for maintaining a gap between an image bearing member and a cylindrical portion of a developer bearing member in an image forming apparatus having at least the image bearing member and the cylindrical developer bearing member that is rotatably held, wherein the gap retaining member is formed of a material that is composed of at least a polybutylene terephthalate resin and a reinforcing material.

DESCRIPTION OF THE PREFERRED EMBODIMENT

Figure 1B:
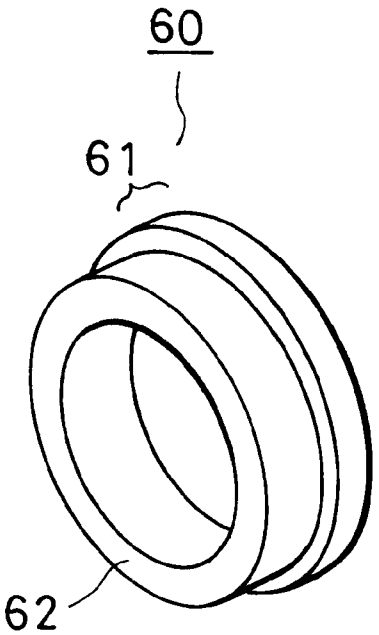
FIG. 1A and FIG. 1B are perspective views showing two typical examples of a gap retaining member.

As the polybutylene terephthalate resin used for making the gap retaining member in accordance with the present invention, commercially available plastics molding materials can be used, such as UBE PBT (trade name; made by Ube Industries, Ltd.), HAUZER (trade name; made by Kuraray Co., Ltd.), Sumicon FM (trade name; made by Sumitomo Bakelite Co., Ltd.), PLANAC (trade name; made by Dainippon Ink & Chemicals Inc.), Teijin PBT (trade name; made by Teijin Ltd.), Crastin (trade name; made by E. I. du Pont de Nemours & Co., Wilmington, Del.), Toray PBT resin (trade name; made by Toray Industries, Inc.), NOVADUR (trade name; made by Mitsubishi Engineering Plastics Co., Ltd.), and TUFPET PBT (trade name; made by Mitsubishi Rayon Co., Ltd.).

The reinforcing material used to enhance the strength of the polybutylene terephthalate resin may be of an organic reinforcing material or an inorganic reinforcing material.

In the present invention, the gap retaining member is further preferably formed of at least a polybutylene terephthalate resin, a reinforcing material, and a lubricant.

According to another aspect of the present invention, there is provided a developing device capable of acting on an image bearing member that includes at least a frame member and a developer bearing member having a cylindrical major part, wherein the foregoing gap retaining member is provided in the vicinity of either end of the developer bearing member.

According to yet another aspect of the present invention, there is provided a process cartridge in which a developing assembly that includes a developing chamber, a developer bearing member, and an image bearing member is installed in a cartridge main body so that the developer bearing member disposed in a developer supply chamber is rotationally driven, with its peripheral surface in rolling contact with a peripheral surface of the image bearing member to transfer the developer carried on the peripheral surface of the developer bearing member onto an electrostatic latent image on the peripheral surface of the image bearing member, the process cartridge being detachably mounted on a main body of an image forming apparatus, wherein the foregoing gap retaining member is provided in the vicinity of either end of the developer bearing member.

A variety of types of organic reinforcing materials, inorganic reinforcing materials, and lubricants may be used for forming the gap retaining member in accordance with the present invention. Preferably, however, an aramid fiber or the like is used as the organic reinforcing material, mica or a potassium titanate fiber or the like is used as the inorganic reinforcing material, and polytetrafluoroethylene, molybdenum sulfide, ultragiant molecular weight polyethylene, or the like is used as the lubricant.

For 100 parts by weight of the polybutylene terephthalate resin, adding amounts of the aforesaid organic and inorganic reinforcing materials normally range from 5 to 50 parts by weight, and an adding amount of the lubricant normally ranges from 5 to 30 parts by weight. When fibers are used as organic and inorganic reinforcing materials, the fibers are used in the form of lint and/or staple.

The gap retaining member can be formed using a compound of the above materials by any method; however, injection molding is generally used.

First, entire constitutions of an image forming apparatus and a process cartridge in accordance with the present invention will be described, then a developing device will be described.

Figure 2:
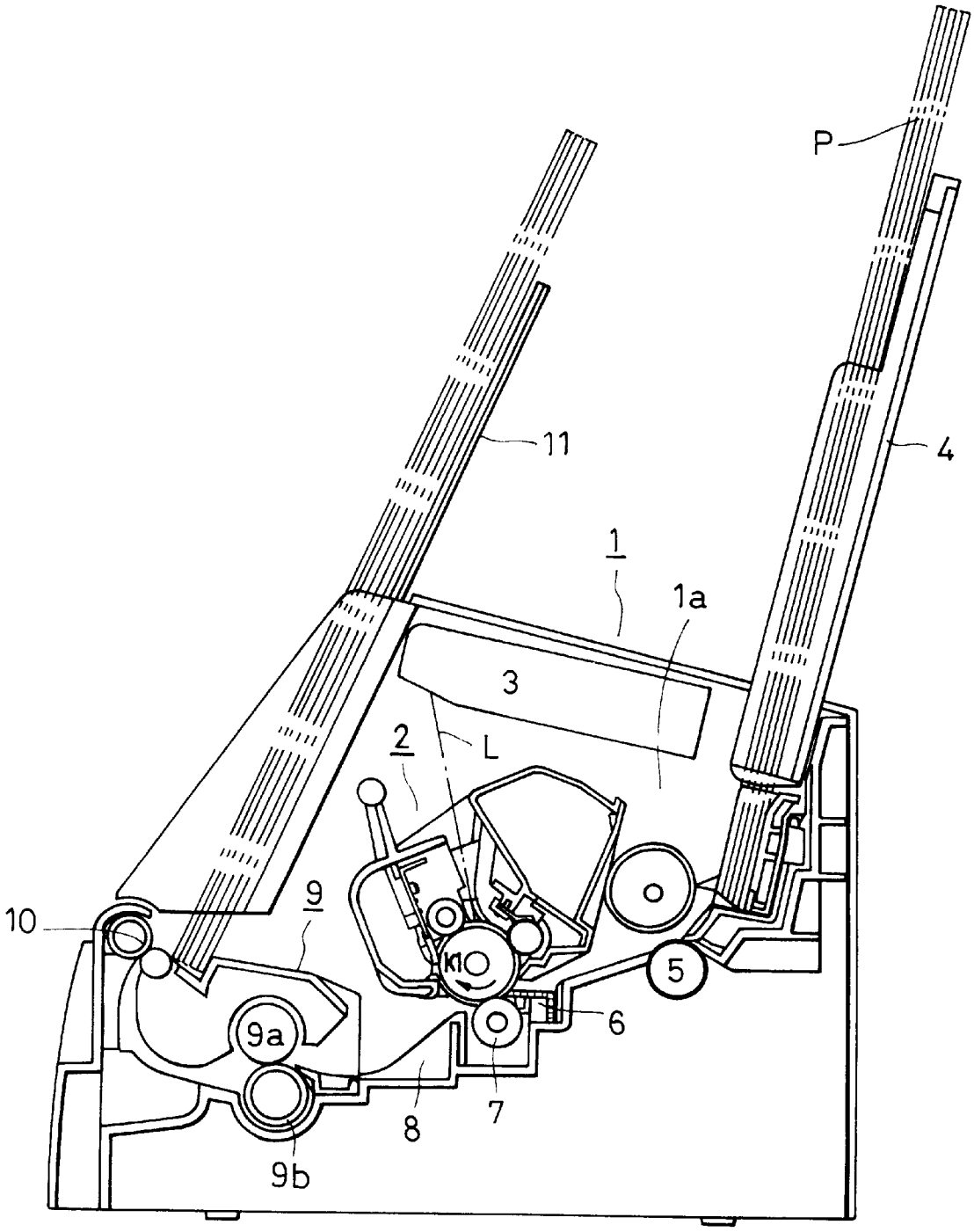
FIG. 2 is a sectional view of an image forming apparatus.

FIG. 2 schematically shows an image forming apparatus main body 1 and a process cartridge 2 in accordance with the present invention. The image forming apparatus main body 1 is a laser printer on which the process cartridge 2 is detachably installed and which utilizes electrophotographic technology.

When the process cartridge 2 is mounted on the image forming apparatus main body 1, an exposure device or a laser scanner unit 3 is disposed above the process cartridge 2, and a paper tray 4 containing a recording medium or paper P on which an image is formed is disposed at the back (right in FIG. 2) of the process cartridge 2. Furthermore, in the image forming apparatus main body 1, a paper feed roller 5, a transfer guide 6, transfer charging roller 7, a conveying guide 8, a fixing device 9, a pair of paper ejection rollers 10, a paper ejection tray 11, etc. are disposed on a resinous frame la in a direction in which the paper P is conveyed.

Figure 3:
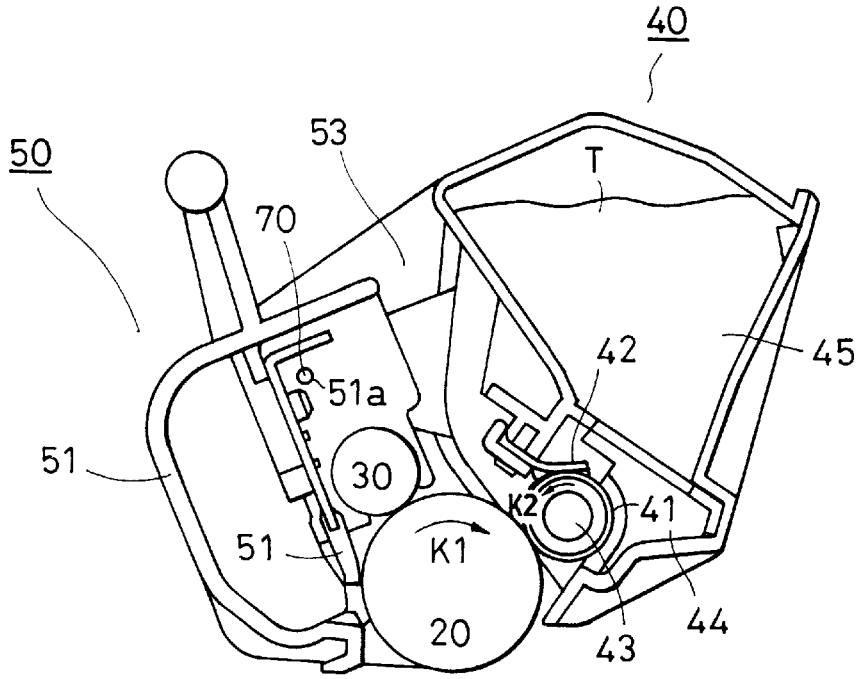
FIG. 3 is a sectional view of a process cartridge.
Figure 4:
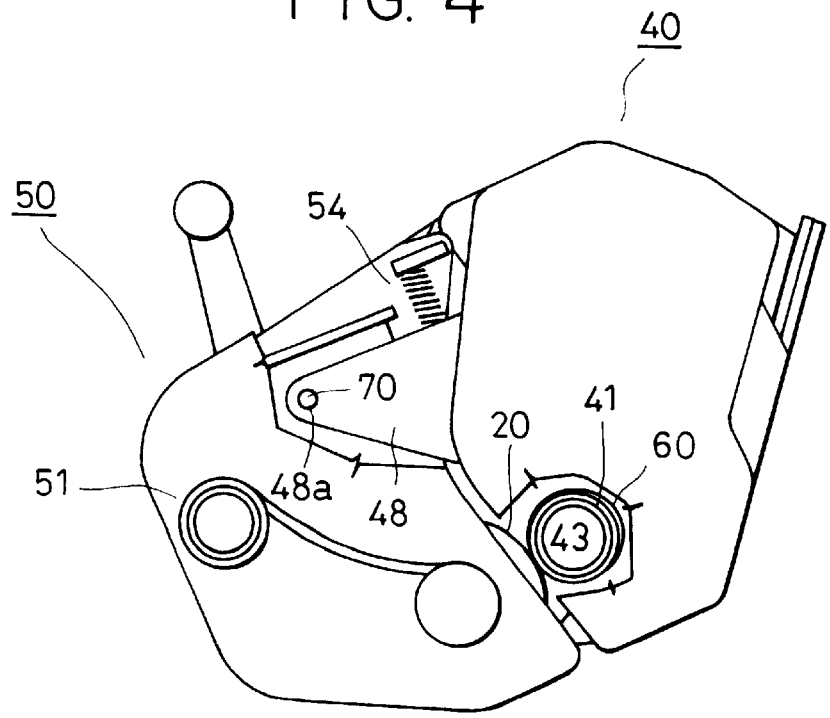
FIG. 4 is a side view of the process cartridge.

Referring now to FIGS. 3 and 4, the process cartridge 2 integrally accommodates four processing devices, namely, an image bearing member or a photosensitive drum 20, a charging device 30, a developing device 40, and a cleaning device 50. The photosensitive drum 20 and the charging device 30 are installed on a cleaning frame 51 of the cleaning device 50. Holes 51*a* are provided in side portions of both ends of the cleaning frame 51. The developing device 40 has coupling arms 48 provided with coupling holes 48*a* in the vicinity of both ends thereof.

A coupling shaft 70 is installed in the holes 51*a* and the coupling holes 48*a,* and the developing device 40 is rotatably installed to the cleaning frame 51. Furthermore, a compression spring 54 serving as an urging means is disposed between the developing device 40 and the cleaning frame 51 to urge the developing device 40 clockwise in FIG. 4.

The process cartridge 2 should be equipped with at least the photosensitive drum 20 and the developing device 40.

A brief description of a process for forming an image will now be given. In response to a print start signal, the photosensitive drum 20 is rotationally driven at a predetermined peripheral velocity or processing speed in a direction K1 indicated by an arrow in the drawing. The charging device 30 to which a bias voltage is applied is in contact with the outer peripheral surface of the photosensitive drum 20. The outer peripheral surface of the photosensitive drum 20 is uniformly charged by the charging device 30.

The laser scanner unit 3 emits a laser beam L that has been modulated according to a time series electrical digital image signal of target image information. The laser beam L enters into the process cartridge 2 through an exposure window 53 on an upper surface of the process cartridge 2 to scan for exposure of the outer peripheral surface or the photosensitive layer 22 of the photosensitive drum 20. This causes an electrostatic latent image based on the target image information to be formed on the outer peripheral surface or the photosensitive layer of the photosensitive drum 20. The electrostatic latent image is developed into a toner image by the developer or toner T applied on the developer bearing member or the developing roller 41 having its layer thickness restricted by the developer restricting member or the developing blade 42 of the developing device 40.

At the same time when the laser beam L is output, the paper P is fed from the paper tray 4 by the paper feed roller 5. The paper P is fed to a transfer position between the photosensitive drum 20 and the transfer charging roller 7 at a proper timing via the transfer guide 6. At the transfer position, the toner image is transferred from the photosensitive drum 20 onto the paper P in sequence.

The paper P on which the toner image has been transferred is separated from the photosensitive drum 20, fed to the fixing device 9 along the conveying guide 8, and passed through the nipped portion between the fixing roller 9*a* and the pressing roller 9*b*. At the nipped portion, the toner image is heated under a pressure for fixation so as to fix the toner image onto the paper P. The paper P on which the toner image has been fixed is carried to the pair of paper ejection rollers 10 and ejected to the paper ejection tray 11.

Toner remaining on the outer peripheral surface of the photosensitive drum 20, which has undergone the transfer process, is removed by the cleaning device 50 before the next cycle of the image forming process beginning with charging is started.

The photosensitive drum 20 is constituted by an aluminum cylindrical base member 21 and a photosensitive layer 22 coated on the outer peripheral surface of the base member 21. The photosensitive layer 22 is composed of a laminate of the electric charge generating layer 22*a* that employs an organic photoconductive material, such as polyvinyl carbazole, oxadiazole, and phthalocyanine, and the electric charge transporting layer 22*b* that employs polycarbonate as a binder.

Figure 5:
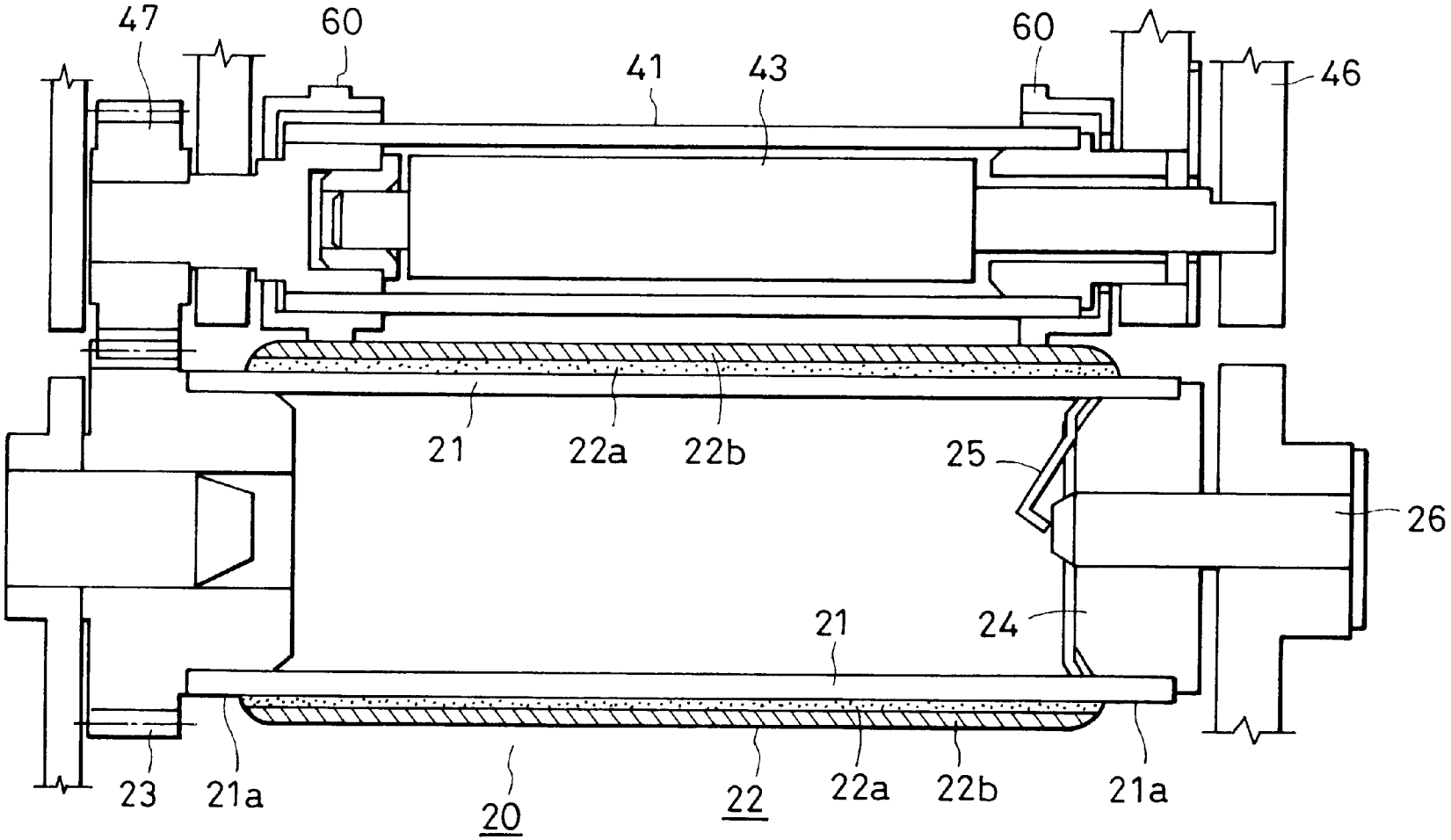
FIG. 5 is a longitudinal sectional view of an image bearing member and a developer bearing member according to an embodiment.

Referring now to FIG. 5, the photosensitive layer 22 is provided over an image forming area and an area that includes portions abutted against the spacer rollers 60, leaving exposed portions 21*a* of the base member at both ends of the photosensitive drum 20.

A drum gear 23 is secured to one end of the photosensitive drum 20, and a drum flange 24 is secured to the other end thereof. The drum flange 24 is provided with a ground sheet metal 25. A part of the ground sheet metal 25 is in contact with the base member 21, and further electrically grounded by the drum shaft 26 and a grounding means (not shown).

Referring now to FIG. 3, the developing device 40 will be described.

The developing device 40 is constituted by the toner chamber 45 containing the developer or toner T, the developer supply chamber 44, the developer bearing member or the developing roller 41, and the developer restricting member or the developing blade 42.

The developing roller 41 is constructed of an aluminum cylindrical member provided with carbon coating (not shown), and has a sleeve gear 47 on one end thereof so as to be rotatably retained relative to the developing device frame 46. The spacer rollers 60 are rotatably fitted on both ends of the developing roller 41. The magnet roller 43 having a plurality of magnetic poles is disposed in the developing roller 41. The magnet roller 43 is held so that it does not rotate relative to the developing device frame 46. The developing blade 42 is fixed to the developing device frame 46 so that one end thereof is pressed against the outer peripheral surface of the developing roller 41.

Figure 1A:
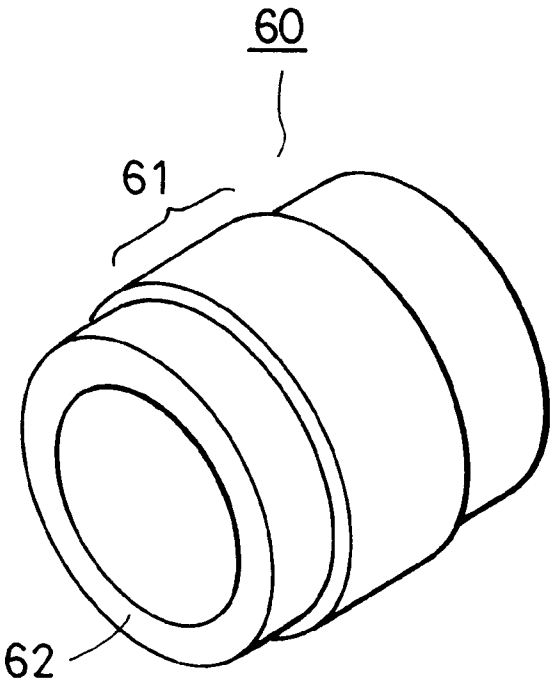

The spacer rollers 60 rotatably mounted at both ends of the developing roller 41 are formed of 85 parts by weight of polybutylene terephthalate (under a trade name "Juranex" made by Polyplastic Co., Ltd.) to which 15 parts by weight of a potassium titanate fiber has been added. As shown in FIG. 1, the spacer rollers 60 have abutting portions 61 abutted against the photosensitive drum 20, and position restricting portions 62 that bump against end surfaces of the developing roller 41 to restrict the positions in a thrust direction in relation to the developing roller 41. The spacer rollers 60 in this embodiment in particular are thin-wall moldings that have an inside diameter of 12 mm. The wall thickness of the abutting portions 61 ranges, for example, from 0.2 mm to 0.5 mm (about 0.3 mm in the embodiment).

In the process cartridge 2, the developing roller 41 is pressed toward the photosensitive drum 20 by the compression spring 54. At this time, the abutting portions 61 of the spacer rollers 60 are clamped between the developing roller 41 and the photosensitive drum 20 to thereby stably maintain the gap between the developing roller 41 and the photosensitive drum 20 at a predetermined value. The abutting portions 61 of the spacer rollers 60 abut against the photosensitive layer 22 of the photosensitive drum 20. The sleeve gear 47 and the drum gear 23 engage each other to form a gear train.

When the image forming apparatus is operated, the photosensitive drum 20 is rotationally driven in direction k1 by a gear (not shown), and the developing roller 41 is rotationally driven in direction k2 by the gear train. At this time, the spacer rollers 60 are rotated in direction k2 as the photosensitive drum 20 rotates in direction k1 and the developing roller 41 rotates in direction k2. As the image forming apparatus operates, the fixing device 9, the laser scanner unit 3, a controller (not shown), etc. generate heat. The generated heat is reserved inside the apparatus main body 1. Therefore, the abutting portions 61 of the spacer rollers 60 are repeatedly subjected to compressive stress at high temperature (40 to 50 degrees Celsius in the image forming apparatus of this embodiment).

The spacer rollers 60 formed of PBT and the potassium titanate fiber in accordance with the present invention exhibit markedly improved rolling resistance and wear resistance, as compared with conventional spacer rollers formed of polyacetal (POM). To be more specific, when 2,500 sheets of letter paper were printed using the image forming apparatus 1 of the embodiment by employing spacer rollers with the abutting portions 61 that have a width of 1.5 mm, deformation and a change of 5.5 $\mu$m in wall thickness were observed in the conventional spacer rollers formed of POM, while a change in wall thickness was 1.7 $\mu$m and no deformation was observed in the spacer rollers 60 formed of PBT and the potassium titanate fiber in accordance with the present invention.

In the image forming apparatus wherein the exposed portions 21*a* are provided at ends of the photosensitive drum 20 as in the case of this embodiment, the surfaces of the abutting portions 61 of the spacer rollers 60 are charged since the abutting portions 61 of the spacer rollers 60 abut against and frictionally slide on the charge transporting layer 22*b* of the photosensitive layer 22 of the photosensitive drum 20. The electric charges are discharged toward the exposed portions 21*a* of the photosensitive drum 20, causing field emission voltages in some cases.

In this embodiment, a distance between the abutting portions 61 of the spacer rollers 60 and the exposed portions 21*a* is set to about 2.0 mm to about 2.5 mm. Experimentally, it has been found that there is a possibility of generation of a field emission voltage in a frequency band centering around approximately 560 MHz. In this embodiment, the spacer rollers 60 use PBT for its base member to be able to control a field emission voltage value. For example, it has been found that spacer rollers formed of polyphenylene sulfide (PPS) exhibit excellent durability; however, the spacer rollers formed of PPS are apt to be charged from friction. Hence, a field emission voltage is generated in the image forming apparatus of this embodiment. To be more specific, a peak value of a field emission voltage in the vicinity of 560 MHz is about 48 dBuV/m in the case of the spacer rollers 60 formed of PPS, while the peak value is controlled to about 20 dBuV/m or less, which is a background noise, in the case of the spacer rollers 60 formed of a material having PBT as its base component.

In this embodiment, the same advantages were obtained when the spacer rollers were formed using a material composed of 75 parts by weight of polybutylene terephthalate (trade name: Juranex) to which 15 parts by weight of mica and 10 parts by weight of polytetrafluoroethylene have been added.

What is claimed is:

1. A gap retaining member for maintaining a gap between an image bearing member and a cylindrical portion of a developer bearing member in an image forming apparatus having at least the image bearing member and the cylindrical developer bearing member that is rotatably held, said gap retaining member comprising:

a substantially hollow cylindrical body including an abutting portion having a wall thickness greater than a wall thickness of an adjacent portion of said cylindrical body formed on a periphery of said cylindrical body, said abutting portion maintaining a gap between the image bearing member and the developer bearing member, wherein said gap retaining member is formed of a material that is composed of at least a polybutylene terephthalate resin and a reinforcing material.

2. A gap retaining member according to claim 1, wherein said gap retaining member is formed of at least a polybutylene terephthalate resin, a reinforcing material, and a lubricant.

3. A gap retaining member according to claim 1 or 2, wherein the reinforcing material is an aramid fiber.

4. A gap retaining member according to claim 1 or 2, wherein the reinforcing material has been selected from a group consisting of mica and a potassium titanate fiber.

5. A gap retaining member according to claim 2, wherein the lubricant has been selected from a group consisting of polytetrafluoroethylene, molybdenum sulfide, and ultragiant molecular weight polyethylene.

6. A developing device including at least a frame member and a developer bearing member having a cylindrical major section, the developing device further comprising said gap retaining member according to claim 1 or 2 in the vicinity of both ends of the developer bearing member.

7. A process cartridge in which a developing assembly that includes a developing member, a developer bearing member, and an image bearing member is installed in a cartridge main body so that the developer bearing member disposed in a developer supply chamber is rotationally driven, with its peripheral surface in rolling contact with a peripheral surface of the image bearing member to transfer the developer carried on the peripheral surface of the developer bearing member onto an electrostatic latent image on the peripheral surface of the image bearing member, the process cartridge being detachably mounted on a main body of an image forming apparatus, wherein said gap retaining member according to claim 1 or 2 is provided in the vicinity of either end of the developer bearing member.

8. A gap retaining member according to claim 2, wherein the reinforcing material comprises an organic material.

9. A gap retaining member according to claim 2, wherein the reinforcing material comprises an inorganic material.

10. A gap retaining member according to claim 8, wherein the polybutylene terephthalate resin is present in an amount of 100 parts by weight, the organic reinforcing material is present in an amount of from 5 to 50 parts by weight, and the lubricant is present in an amount of from 5 to 30 parts by weight.

11. A gap retaining member according to claim 9, wherein the polybutylene terephthalate resin is present in an amount of 100 parts by weight, the inorganic reinforcing material is present in amount of from 5 to 50 parts by weight, and the lubricant is present in an amount of from 5 to 30 parts by weight.

12. A gap retaining member according to claim 8, wherein the organic reinforcing material is a fiber in the form of a lint.

13. A gap retain member according to claim 8, wherein the organic reinforcing material is a fiber in the form of a staple.

14. A gap retaining member according to claim 9, wherein the inorganic reinforcing material is in the form of a lint.

15. A gap retaining member according to claim 9, wherein the inorganic reinforcing material is in the form of a lint.

* * * * *

UNITED STATES PATENT AND TRADEMARK OFFICE

CERTIFICATE OF CORRECTION

PATENT NO. : 6,240,268 B1
DATED : May 29, 2001
INVENTOR(S) : Tsutomu Nishiuwatoko It is certified that error appears in the above-identified patent and that said Letters Patent is hereby corrected as shown below:

Column 10,
Line 2, "amount" should read -- an amount --; and
Line 8, "retain" should read -- retaining --.

Signed and Sealed this

Ninth Day of April, 2002

*Attest:*

*Attesting Officer*

JAMES E. ROGAN
*Director of the United States Patent and Trademark Office*